United States Patent [19]

Fitoussi et al.

[11] 4,404,130

[45] Sep. 13, 1983

[54] PROCESS FOR THE PLUTONIUM DECONTAMINATION OF AN ORGANIC SOLVENT

[75] Inventors: Richard Fitoussi, Paris; Claude Musikas, Villebon, both of France

[73] Assignee: Commissariat a l'Energie Atomique, Paris, France

[21] Appl. No.: 242,656

[22] Filed: Mar. 11, 1981

[30] Foreign Application Priority Data

Mar. 13, 1980 [FR] France ..... 80 05626

[51] Int. Cl.[3] ..... G21F 9/06

[52] U.S. Cl. ..... 252/631; 210/639; 423/10; 423/8

[58] Field of Search ..... 423/10, 8; 260/920; 252/631; 210/639

[56] References Cited

U.S. PATENT DOCUMENTS 3,580,705 5/1971 Coleman et al. ..... 252/627 X 3,980,750 9/1976 Cousinou et al. ..... 423/10 X

OTHER PUBLICATIONS

M. Curtui, I. Haiduc, Solvent Extraction of Dioxouranium (VI) with Dialkylphosphorodithioc Acids-VI, J. Inorg. Nucl. Chem., vol. 43, pp. 1078-1079, 1981.

*Primary Examiner*—Deborah L. Kyle

*Assistant Examiner*—Catherine S. Kilby

*Attorney, Agent, or Firm*—Pearne, Gordon, Sessions, McCoy, Granger & Tilberry

[57] ABSTRACT

Process for the plutonium decontamination of an organic solvent comprising adding to the said organic solvent a reducing agent which is a dialkyl dithiophosphoric acid and which is soluble in the organic solvent, bringing the organic solvent containing the reducing agent into contact with an acid aqueous solution and separating the aqueous solution containing the plutonium from the decontaminated organic solvent, useful in reprocessing of irradiated nuclear fuels.

12 Claims, 2 Drawing Figures

PROCESS FOR THE PLUTONIUM DECONTAMINATION OF AN ORGANIC SOLVENT

BACKGROUND OF THE INVENTION

The present invention relates to a process for the plutonium decontamination of an organic solvent, particularly a spent organic solvent such as tributylphosphate, which has been used for uranium-plutonium separation during the reprocessing of irradiated nuclear fuels.

It is known that organic solvents such as tributylphosphate, which have been used for the reprocessing of irradiated nuclear fuels are essentially degraded by alpha radiolysis and by hydrolysis. Moreover, a variable quantity of plutonium is also held back in the spent organic solvent. When the solvent is tributylphosphate, plutonium is held back in it probably due to the presence of small quantities of dibutylphosphoric acid, which forms with the plutonium complexes which are more stable than plutonium-tributylphosphate complexes.

When these spent solvents are purified by washing with alkaline solutions, the solvent is regenerated, but washing solutions are obtained which have a by no means negligible alpha radioactivity. This leads to large quantities of alkaline radioactive effluents and consequently increases the volume of the radioactive waste to be processed.

To obviate this disadvantage, it is desirable to recover as quantitatively as possible the plutonium present in the spent organic solvents before they undergo the basic regeneration treatment.

BRIEF SUMMARY OF THE INVENTION

The process according to the invention relates to a process for plutonium decontamination of an organic solvent making it possible to satisfactorily recover the plutonium contained in said solvent.

This process for the plutonium decontamination of an organic solvent comprises adding to the said organic solvent a reducing agent which is soluble therein and which is constituted by dialkyl dithiophosphoric acid, b ringing the organic solvent containing this reducing agent into contact with an acid aqueous solution and separating the aqueous solution containing the plutonium from the decontaminated organic solvent.

Advantageously, a dialkyl dithiophosphoric acid is used, whose alkyl radicals have 1 to 4 carbon atoms, for example diethyl dithiophosphoric acid or dibutyldithiophosphoric acid.

The process as characterized hereinbefore advantageously makes use of the fact that by using dialkyl dithiophosphoric acid as the reducing agent it is possible to reduce under good conditions the plutonium present in the said solvent and then reextract it in an acid aqueous solution such as a nitric solution.

Thus, compared with the hitherto known organic reducing agents such as dialkyl dihydroquinones (U.S. Pat. No. 3,580,705) or aromatic organic compounds (French Patent 2,212,611) certain advantages result from the use of a dialkyl dithiophosphoric acid. The latter is soluble in the organic solvent, whereas the aromatic organic compounds are divided between the aqueous phase and the organic phase, leading to an inferior performance. Moreover, the reducing agent according to the invention can be used in the presence of a nitric acid, which is not the case with dialkyl hydroquinones as they are destroyed by oxidation in the presence of nitric acid.

It is thought that the oxidation reaction of the dialkyl dithiophosphoric acid corresponds to the formation of a polysulphide in accordance with the following reaction diagram:

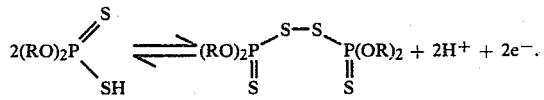

Thus, by using in accordance with the present invention dialkyl dithiophosphoric acids which are just as effective as reducing agents as those presently used, it is possible to reduce the plutonium in the organic phase and reextract it in an aqueous phase constituted by an acid solution.

Advantageously, the acid aqueous solution is a mineral acid solution, such as nitric acid, hydrochloric acid or sulphuric acid.

The acidity of this solution can vary within a wide range, because the plutonium reextraction kinetics are not affected by the acidity of the aqueous phase.

Thus, for plutonium reextractions carried out by using dibutyldithiophosphoric acid as the reducing agent, equivalent results are obtained when the acidity of the nitric aqueous phase varies between 0.01 and 1 N.

However, when the reducing agent is diethyl dithiophosphoric acid it is preferable to use an aqueous solution having an acidity at least equal to 0.5 N because, in this case, the reducing agent is slightly soluble in a weakly acid medium.

Advantageously contacting between the spent organic solvent containing the reducing agent and the acid aqueous solution takes place at a temperature above 10° C., preferably between 10° and 60° C., because the reextraction speed increases with the temperature.

After reextracting the plutonium present in the organic solvent, the decontaminated solvent preferably undergoes a complementary purification treatment in order to eliminate the excess reducing agent and the oxidation products formed in the solvent from the said reducing agent.

In view of the fact that dithiophosphoric acid salts with short hydrocarbon chains ($C_1$ to $C_4$) are highly soluble in a basic medium, this purification treatment is advantageously carried out by bringing the decontaminated organic solvent into contact with a basic solution, such as a sodium carbonate solution.

Thus, washing with a 0.6 M sodium carbonate solution with a stirring time of 5 minutes at ambient temperature makes it possible to eliminate more than 99% of the diethyl dithiophosphoric acid and more than 90% of the dibutyl dithiophosphoric acid present in an organic solvent.

However, this treatment by means of a basic solution does not make it possible to eliminate the oxidation products from the dialkyl dithiophosphoric acids, e.g. disulphides, which are highly soluble in the organic phase.

According to the invention, this elimination is obtained by carrying out the basic purification treatment of the decontaminated solvent in the presence of an oxidizing agent such as sodium nitrite, which is added to the basic solution.

Under these conditions, the disulphide is oxidized in accordance with the following reaction:

Thus, the disulphide is transformed into products which are soluble in the aqueous phase which, during the basic purification treatment of the decontaminated solvent, makes it possible also to eliminate the oxidation products from the dialkyl dithiophosphoric acids.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

These examples relate to the decontamination treatment of a spent organic solvent, constituted by tributylphosphate diluted in dodecane, the tributylphosphate content of the solvent being 30%.

It is pointed out that this spent solvent is obtained from an irradiated fuel reprocessing installation where it was used for 5 to 6 months as the extraction solvent used in pulsed columns. This corresponds to the performance of approximately 50 extraction cycles, each involving the extraction of uranium and plutonium, washing of the plutonium by nitric acid, uranium-plutonium separation by reducing the plutonium by means of uranium IV, washing the uranium with 30% tributylphosphate in dodecane and two uranium reextractions.

This cycle is followed by a solvent regeneration treatment in a mixer-settler, which consists of successively washing the solvent with a 0.6 M sodium carbonate solution, a 1 N nitric acid solution and a 1 N NaOH solution.

In the following examples, the solvent which undergoes the decontamination treatment is sampled prior to the regeneration treatment in a mixer-settler.

In all these examples, the solvent is decontaminated by contacting, accompanied by stirring by means of a rotary magnetic bar, 20 cc of an aqueous nitric acid solution and 20 cc of spent organic solvent comprising a reducing agent constituted either by diethyl dithiophosphoric acid with a purity of approximately 90% or dibutyldithiophosphoric acid with a purity of at least 95%.

Extraction is carried out in an apparatus thermostatically controlled by the circulation of water and the plutonium content of each of the phases is determined after settling by alpha counting using a ZnS scintillator or a type EMIA 2 ionization chamber.

After determining the plutonium content of the two phases, the partition coefficient D of the plutonium is evaluated, this corresponding to the ratio of the plutonium concentration of the organic phase to the plutonium concentration of the aqueous phase.

EXAMPLE 1

This spent solvent treatment example applies to the case where it is desired to limit the quantities of reagents added and where no heating possibilities exist. Following uranium-plutonium partition during the reprocessing of irradiated fuels, $10^{-2}$ M/l of diethyldithiophosphoric acid is added to the solvent and energetic stirring takes place in the presence of a 0.3 N nitric acid aqueous solution at a rate of 0.5 volume/volume of solvent. After 60 minutes, the mixture is allowed to settle. The determination of the phases makes it possible to establish that the partition coefficient of plutonium is $2.10^{-3}$ (cf FIG. 1) representing a 99.6% reextraction of the plutonium initially present in the solvent. The latter is then transferred to the carbonic regeneration unit where the diethyl dithiophosphoric acid excess is eliminated. One extraction stage is sufficient to reextract more than 99% of the product after 5 minutes contact.

Figure 1:
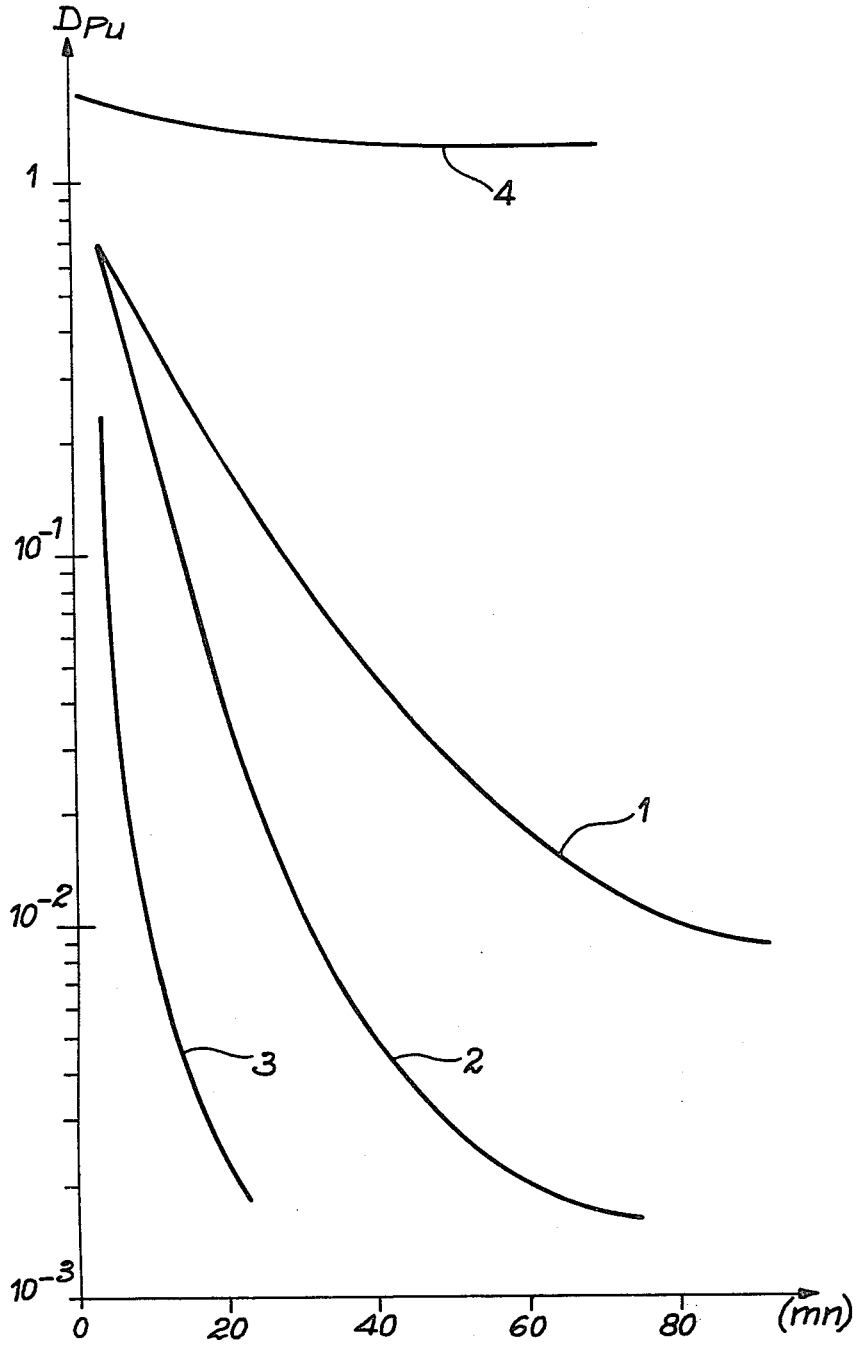
FIG. 1 is a graph showing the variations in the partition coefficient D of plutonium as a function of time for various reducing agent concentrations.

By carrying out a number of reextractions, with diethyl dithiophosphoric acid concentrations in the organic phase of $5.10^{-3}$ M, $10^{-2}$ M and $2.10^{-2}$ M and variable times, the curves of FIG. 1 are obtained which represent the variations of the partition coefficient D of plutonium as a function of the reextraction time (in minutes).

In FIG. 1 curves 1, 2 and 3 respectively relate to reextractions carried out with a diethyl dithiophosphoric acid concentration in the spent solvent of $5.10^{-3}$ M, $10^{-2}$ M and $2.10^{-2}$ M, whilst curve 4 illustrates the variations of the plutonium partition coefficient D for a reextraction carried out under the same conditions, but with the reducing agent absent.

This drawing shows that the addition of diethyl dithiophosphoric acid to the spent organic solvent makes it possible to eliminate virtually all the plutonium. It can also be seen that the extraction rate increases significantly with the reducing agent concentration.

Thus, diethyl dithiophosphoric acid is clearly a very effective reducing agent, because only 5 minutes are required for reextracting 97% of the plutonium when the reducing agent concentration of the organic phase is $2.10^{-2}$ M at ambient temperature (23° C.).

EXAMPLE 2

This example applies to the case where a heating system is available and where it is desired to limit the contact time between the aqueous phase and the organic phase. It is also possible to use small quantities of reagent. After heating the spent solvent from the uranium-plutonium partition cycle to 40° C., $5.10^{-3}$ M/l of dibutyldithiophosphoric acid is added to it in the presence of a 0.05 N nitric acid aqueous solution also heated to 40° C. After 5 minutes contact, the phases are decanted and it is found that the plutonium partition coefficient is 0.0014 (cf FIG. 2). Thus, 99.7% of the plutonium has been reextracted when working with an organic phase to aqueous phase volume ratio equal to 2. As an example 1, the solvent is then passed for carbonic treatment, however, two reextraction stages are required for eliminating 99% of the dibutyldithiophosphoric acid with a contact time of 5 minutes.

Figure 2:
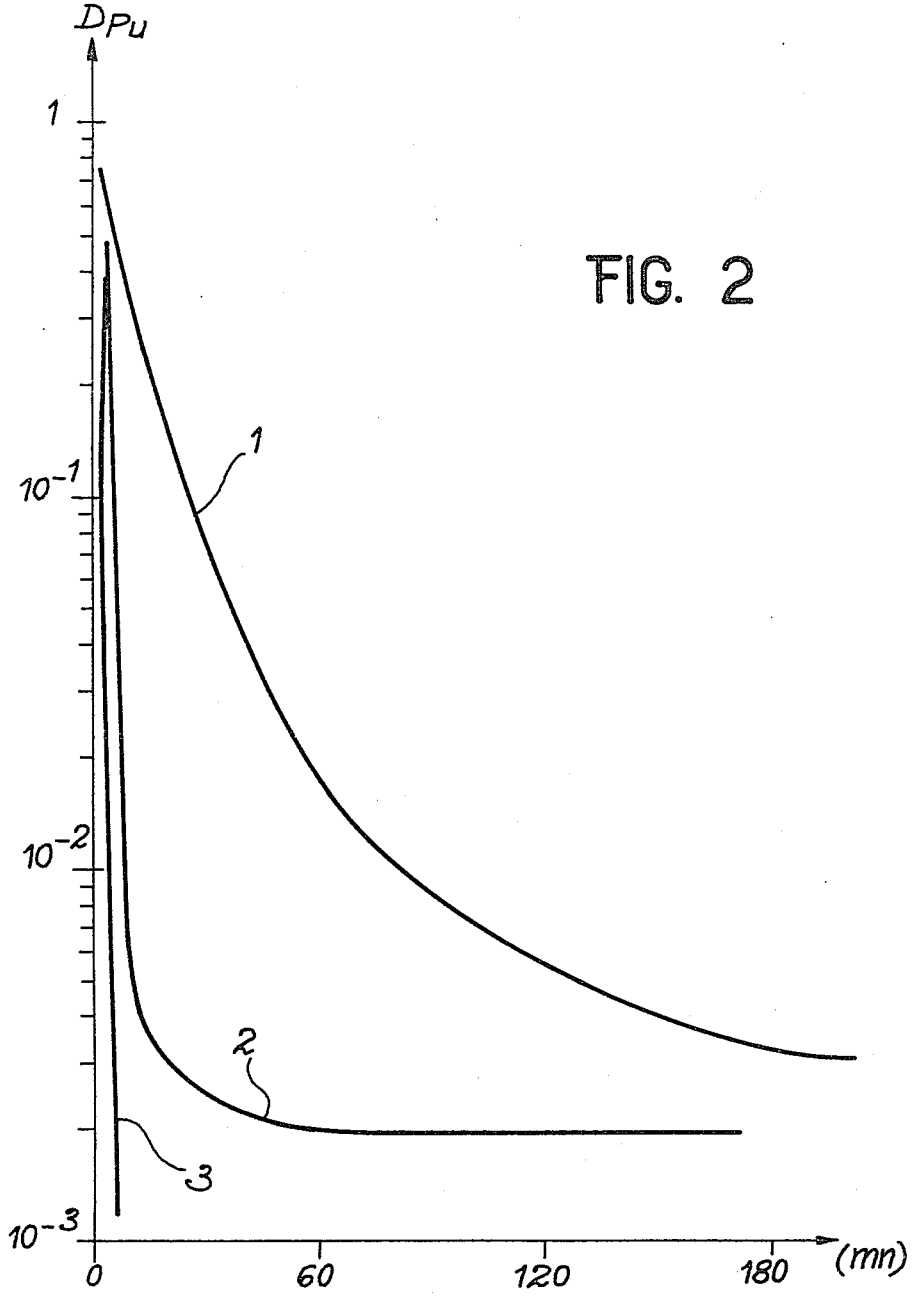
FIG. 2 a graph showing the variations of the partition coefficient D of plutonium as a function of time for different temperatures.

By carrying out several plutonium reextractions at temperatures of 23°, 30° and 40° C. and by in each case determining the plutonium partition coefficient D, FIG. 2 is obtained, whose curves 1, 2 and 3 respectively represent variations of the plutonium partition coefficient D as a function of the time for reextractions carried out at 23°, 30° and 40° C.

On the basis of FIG. 2, it can be seen that the reextraction rate increases with the temperature. Thus, at 40° C. (curve 3) less than 5 minutes are required to obtain a plutonium partition coefficient below $10^{-3}$.

EXAMPLE 3

This example applies to the case where the temperature in the reprocessing installation is close to 30° C. In this case, no heating is carried out and the dibutyldithiophosphoric acid concentration is $5.10^{-3}$ M. After 10 minutes contacting time, the plutonium partition coefficient is equal to 0.003 (cf FIG. 2) and 99.7% of the plutonium has been eliminated from the solvent using 1 volume of 0.05 N nitric acid aqueous solvent for 1 volume of solvent. The latter is then transferred to the carbonic regeneration unit. Elimination of 99% of the dibutyldithiophosphoric acid requires two 5 minute contact times, as in example 1.

The plutonium content of the organic solvent treated in the three examples described is 20 mg/l.

Thus, the process according to the invention makes it possible to obtain a satisfactory plutonium decontamination of both acid and basic organic solvents. This process is also of great interest for the plutonium decontamination of spent organic solvents prior to basic regeneration treatment, thereby making it possible to prevent the formation of alkaline radioactive effluents. Moreover, it permits a quantitative recovery of the plutonium held back in a spent solvent, whilst requiring but little reagent.

We claim:

1. A process for the plutonium decontamination of an organic solvent, comprising adding to said organic solvent a reducing agent which is soluble therein and consists of a dialkyl dithiophosphoric acid, bringing the organic solvent containing the reducing agent into contact with an acid aqueous solution and separating the aqueous solution containing the plutonium from the decontaminated organic solvent.

2. A process according to claim 1, wherein the dialkyl dithiophosphoric acid is diethyl dithiophosphoric acid.

3. A process according to claim 1, wherein the dialkyl dithiophosphoric acid is dibutyldithiophosphoric acid.

4. A process according to claim 1, wherein the acid aqueous solution is a mineral acid selected from the group consisting of nitric acid, hydrochloric acid or sulphuric acid.

5. A process according to claim 1, wherein the acid aqueous solution has an acidity between 0.01 and 1 N.

6. A process according to claim 1, wherein the organic solvent containing the reducing agent is brought into contact with the acid aqueous solution at a temperature between 10° and 60° C.

7. A process according to claim 1, wherein the decontaminated organic solvent undergoes a complementary purification treatment in order to eliminate excess reducing agent and oxidation products formed in the solvent from said reducing agent, said treatment consisting of bringing the decontaminated organic solvent into contact with a basic solution and separating the basic solution from the purified decontaminated organic solvent.

8. A process according to claim 7, wherein the basic solution is a sodium carbonate solution.

9. A process according to claims 7 or 8, wherein an oxidizing agent is added to the basic solution.

10. A process according to claim 9, wherein the oxidizing agent is sodium nitrite.

11. A process according to claim 1, wherein the organic solvent comprises tributylphosphate.

12. A process according to claim 1, wherein the acid aqueous solution is a mineral acid solution.

* * * * *